US005797076A

United States Patent [19]

Bracken et al.

[11] Patent Number: 5,797,076

[45] Date of Patent: Aug. 18, 1998

[54] ABRASIVE SHIM COMPLIANT DOCTOR BLADE

[75] Inventors: Peter Wallace Bracken; Jeffery Richard Brener; Martin Victor Digirolamo; Samuel Edward Mullinix, Jr., all of Lexington; Donald Wayne Stafford, Richmond; Peter Eric Wallen, Lexington, all of Ky.

[73] Assignee: Lexmark International, Inc., Lexington, Ky.

[21] Appl. No.: 854,399

[22] Filed: May 12, 1997

[51] Int. Cl.[6] ..... G03G 15/08

[52] U.S. Cl. ..... 399/284; 399/274

[58] Field of Search ..... 399/222, 265, 399/274, 279, 284

[56] References Cited

U.S. PATENT DOCUMENTS 4,233,935 11/1980 Uehara et al. ..... 399/274

4,286,543 9/1981 Ohnuma et al. ..... 399/274

5,085,171 2/1992 Aulick et al. .

5,623,718 4/1997 Bracken et al. ..... 399/284

5,648,838 7/1997 Michlin et al. ..... 399/284 X

*Primary Examiner*—Sandra L. Brase

*Attorney, Agent, or Firm*—John A. Brady

[57] ABSTRACT

A compliant doctor blade has a metal bar (13) with bottom attached by dual side adhesive tape (15) to a resilient layer of porous foam (7). The bottom of the foam layer is attached by dual side adhesive tape (8) to a shim (1), which is stiff in the direction of movement of the roller (9) which the shim contacts. The shim has a polyester body (3) and a bottom layer (5) containing abrasive grit and conductive carbon black. Finally, the end of the doctor blade is dipped in a conductive paste which hardens into a conductive coating (17) which bridges the conductive layer of the shim and the metal bar. Advantages are reduced costs and improved performance, particularly with respect to streaks from prenip packing.

16 Claims, 1 Drawing Sheet

ABRASIVE SHIM COMPLIANT DOCTOR BLADE

TECHNICAL FIELD

This invention relates to electrophotographic development and, more particularly, relates to a compliant doctor blade operative on a developer roller.

BACKGROUND OF THE INVENTION

U.S. Pat. No. 5,085,171 to Aulick et al., assigned to the same assignee to which this application is assigned, is directed to a compliant doctor blade having a thin metal outer layer on a grit surface which faces the developer roller. This replaces prior rigid doctor blades which therefore could permit the toner layer of the developer roller to vary with surface variations in the doctor blade itself and the developer roller it comes in contact with. Such variations cause variations in the visible image made by the toner, both print and graphics. A compliant doctor blade ideally eliminates such variations.

U.S. Pat. No. 5,623,718 assigned to the same assignee to which this application is assigned, describes subject matter sold in the United States commercially by the assignee of this application and which is prior art to this application. That doctor blade constitutes a compliant doctor blade in which the compliant, doctoring tape has a solid binder containing dispersed grit particles and a conductive filler. Such a compliant member extends the functioning life of the doctor blade. Additionally, that doctor blade has a rigid front extension to form a barrier to almost all of the area back from the nip of the compliant member and the developer roller. This eliminates the potential for a wedge of toner to form at the nip. When such a wedge forms, it interferes with the ability of the doctor blade to meter the correct amount of toner.

Three patent applications assigned to the assignee of this invention as follows are not prior art as they share inventors with this application and they describe subject matter which has been sold commercially for less than one year: U.S. patent application Ser. No. 08/724,881, filed Nov. 3, 1996, now U.S. Pat. No. 5,708,943, is directed to compliant doctor blades with a grit layer containing molybdenum disulfide to eliminate filming of toner. The same grit layer is used as the grit layer of the preferred embodiment of this invention. U.S. patent application Ser. No. 08/623,362, filed on Mar. 28, 1996, is directed a conductive ink formula for use with compliant doctor blades. The same conductive ink is used as the conductive ink of the preferred embodiment of this invention. U.S. patent application Ser. No. 08/623,363, also filed Mar. 28, 1996, now U.S. Pat. No. 5,702,812, is directed to compliant doctor blades with a rigid shim, on the bottom of a foam layer over which a tape having abrasive is positioned. The shim controls the size of the nip to prevent formation of a wedge of toner in the nip.

This invention eliminates the tape by employing simply a shim with an abrasive surface. A relatively lengthy conductive tape is replaced with conductive, abrasive material only on the shim.

DISCLOSURE OF THE INVENTION

In accordance with this invention a compliant doctor blade comprises a conductive metal bar having a lower surface to which a resilient layer is attached. The lower surface of the resilient layer has attached to it a stiff shim, the shim having a bottom layer of conductive and abrasive material. At an end of the doctor blade a resilient conductive coating bridges the abrasive layer and the metal bar. For best functioning, the lower end of the conductive blade is at an angle at which the developer roller makes nip contact in the middle of the layer of abrasive material.

BRIEF DESCRIPTION OF THE DRAWING

The details of this invention will be described in connection with the accompanying drawing in which.

BEST MODE FOR CARRYING OUT THE INVENTION

Figure 2:
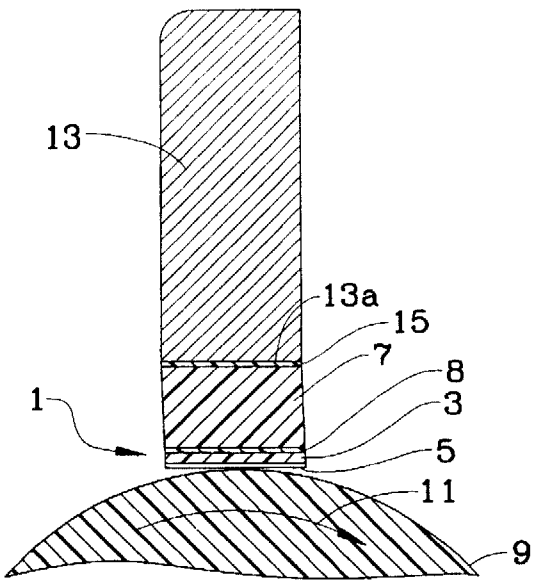
FIG. 1 is a perspective view of the doctor blade and FIG. 2 is a cross-section of the doctor blade.

The doctor blade of this invention has the desired compliance with the developer roller but does not have a funnel shaped prenip which can occur with some doctor blades as discussed in the foregoing. Shim 1 is a lamination of a polyester layer 3 (FIG. 2) and an abrasive and conductive layer 5. Shim 1 is attached to the bottom surface of a resilient foam layer 7 by a dual side adhesive tape 8, which may be a commercially available dual side adhesive tape which comprises 1 mil thick polyester having adhesive on both sides.

In use the abrasive and conductive layer 5 contacts a developer roller 9. The stiffness of the shim 1 in the direction of movement of roller 9, shown by arrow 11, the process direction, prevents the foam from deforming in the pre-nip region and causing the undesirable funnel shape. The stiffness of the shim 1 also prevents an undesired long, radiused nip contact and identically mimics the nip geometry of the steel blade. The pre-nip region of the present invention is nearly identical to that found with a steel doctor blade. In the long direction of shim 1, along the length of the developer roller 9, shim 1 is flexible to conform with the surface of the developer roller.

Figure 1:
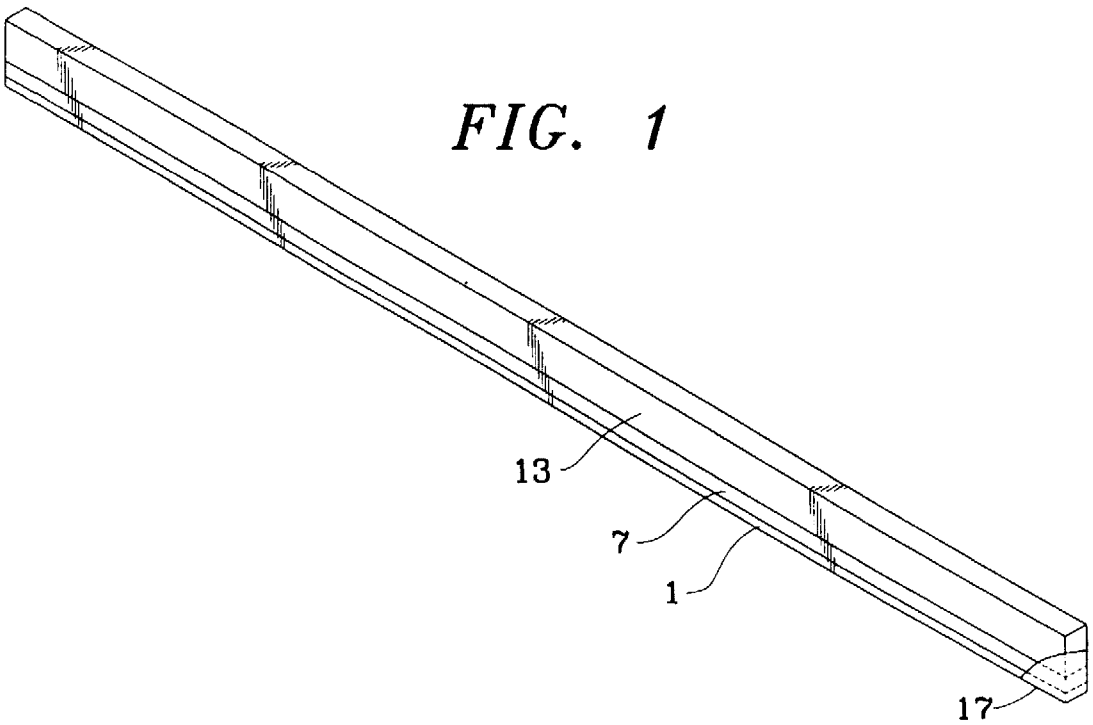

As best shown in FIG. 1, the compliant doctor blade of the present invention comprises a support bar of aluminum 13, preferably, for example, a 4.0 mm×10 mm aluminum 6063-T5 stock bar 231.5 mm in length. In the specific embodiment the bottom surface 13*a* (FIG. 2) has a 6 degree upward angle which compensates for dimensions in the imaging device so that the nip of shim 1 and developer roller 9 can be accurately located in the middle of shim 1. (This is because shim 1 has a relatively small surface and therefore the physical response to being off center is significant. If shim 1 has a considerably larger surface, positioning of the nip in the center would not normally be significant.)

As shown in FIG. 1, shim 1 is coextensive with the length of bar 13. Porous foam layer 7 has a thickness of from about 2.0 to about 3.0 mm and extends the entire length of the support bar 13. A preferred foam material is PORON foam, a polyurethane foam commercially available from Rogers Corp. as #4701-40-20093-1064.

Foam layer 7 may be attached to the underside of the support bar using any conventional adhesive material which will withstand the forces on the doctor blade during use. In the embodiment this adhesive material 15 is a commercially available dual side adhesive tape which comprises 1 mil thick polyester having adhesive on both sides. Foam layer 7 is resilient.

Prior to assembly of shim 1 in the doctor blade, the adhesive and conductive layer 5 is applied to the polyester layer 3. This is done by liquid coating, preferably on sheets of polyester 3. After curing, the sheets are cut mechanically to a very thin connection and then torn apart and applied to foam 7 by hand, the adhesive tape 8 being first applied to foam 7.

The formula for the liquid application of layer 5 is the same as that of the foregoing application directed to the formula carrying molybdenum disulfide, which is as follows:

BINDER LAYER FORMULATION

| Material | Percent by Weight |
|---|---|
| Polyurethane (Z001 of Lord Chemical) | 15 |
| Molybdenum disulfide (plates 10 um ave. particle size) | 30 |
| Carbon black (XE-2 of Degussa) | 5 |
| Silicon carbide (20 um ave. particle size) | 50 |

The foregoing abrasive and conductive layer formulation is thoroughly mixed and applied to form a thin, solid coating 5 (e.g. from about 25 to about 35 microns thick) to polyethylene terephthalate layer 3 of 14 mil thickness. The 5 percent by weight of carbon black results in electrical resistance less than 1×10E5 (ten to the fifth power) ohms/square. The molybdenum disulfide eliminates filming, at least when used with acrylic based toner for which this invention is particularly designed (i.e., the toners such as those of the OPTRA laser printers commercially sold by the assignee of this invention). The polyurethane forms a body holding the silicon carbide as abrasive and the carbon black as conductive filler and the molybdenum disulfide thoroughly mixed in the solid coating 5.

The silicon carbide are grit particles for abrasion. The grit particles generally have a particle size of from about 8 to about 20 micrometers, preferably about 20 micrometers in diameter and are preferably a ceramic oxide such as silicon carbide (e.g., NORBIDE, commercially available from Norton Corp.). Other grit materials which are useful in the present invention include aluminum oxide, diamond powder, titanium dioxide, zirconium dioxide, and mixtures thereof.

The carbon black provides conductivity. The conductivity allows electrical current which is applied to the doctor blade to be conducted to the developer roller 9. The conductive material for use in the present invention is one where conductive particles are included in and dispersed throughout the solid layer 5. Conductive materials which may be used in the present invention include carbon black, graphite, metal fillers, ionic salts, and mixtures thereof. The preferred conducting material is carbon black. The conductive particles should provide layer 5 with an electrical resistance of less than about 1×10E5 ohms/square. Loading of carbon black in the foregoing specific formula higher than 5 percent by weight results in a surface roughness which is too smooth for desired operation of layer 5. By layer 5 being conductive throughout, as layer 5 wears, the electrical properties of the doctor blade remain constant.

Shim 1 is attached to the bottom of the resilient foam layer 7 (i.e., to the face of the layer 7 which faces developer roller 9). In designing shim 1 it is important that it maintains an appropriate balance between stiffness and flexibility. Specifically, shim 1 must maintain stiffness in the process direction (the direction 11 in which developer roller 9 moves), yet maintain flexibility in the direction perpendicular to the process direction (i.e., over the length of the doctor blade). It is the stiffness of shim 1 which provides the appropriate nip configuration, while the flexibility over the length of the doctor blade allows the blade to conform closely to the surface of developer roller 9.

Thus, the doctor blade of the present invention provides the benefits of both an inflexible steel doctor blade and a flexible doctor blade. Any material which maintains this appropriate flexibility/stiffness balance may be used as the body 3 of shim 1 in the present invention. In deciding whether a particular material is appropriate for use as shim 1, both the nature of the material and its thickness will be important. Specifically, if a material is too thin or soft, it may not provide the appropriate degree of stiffness required, while if it is too thick or hard, it may not exhibit the required degree of flexibility. Shim 1 may be made of any material having the required flexibility/stiffness tradeoff and is preferably a material that does not corrode and has an appropriate cost. Examples of material which may be used include brass, phosphorus bronze, beryllium copper, polycarbonate, polyester, and stainless steel. Polyester is the particularly preferred material because it is easier than the metal to cut into the desired shape. Stainless steel is secondarily preferred because of its attractive cost and the fact that it does not corrode.

By way of example, when stainless steel is used as shim 1, a thickness below about 0.004 inch (0.102 mm) makes the shim too fragile. When polyester, specifically MYLAR polyethylene terephthalate commercially available from Dupont, is used, a thickness of shim 1 below about 0.014 inch (0.356 mm) makes the material too flexible; greater thickness is required. On the other hand, stainless steel at a thickness of greater than about 0.012 inch (0.305 mm) is too thick and does not provide the required degree of flexibility. Thus, the thickness for the shim material selected is purely a function of the stiffness/flexibility required. The shim material utilized in the doctor blade of the present invention should have a stiffness of from about 0.5 to about 31.0, preferably from about 10.0 to about 25.0, inches of deflection/inch of length/pound of force. This stiffness is measured as follows: a 4 mm wide shim is fixed at one end and loaded at the other (the magnitude of the load should be sufficiently low to prevent plastic deformation of the shim); the displacement of the loaded end is then measured. Put another way, the shim should have a stiffness which is greater than that of 0.014 inch thick polyester and less than or equal to that of 0.012 inch thick stainless steel. The preferred shim 1 has a body, layer 3, which is the polyester of 0.014 inch thickness, the stiffness of which is slightly increased also by the abrasive/conductive layer 5.

Electrical conductivity between the aluminum bar 13 and the abrasive/conductive layer 5 is provided by a coating of conductive adhesive 17 on one or both ends of the doctor blade. This forms a continuous layer which contacts the abrasive/conductive layer 5 and the aluminum bar 13, thereby providing an electrical path between layer 5 and bar 13. The ends of the doctor blade are past the location on developer roller 9 which develop an image, so the slight irregularity of toner flow from adhesive 17 is not material to imaging. The material of adhesive 17 is the same as that of the foregoing application Ser. No. 08/623,362.

That material is a conductive paste comprising from about 70% to about 96% (preferably about 94% to about 96%) of a flexible elastomer having a hardness of less than about 50 Shore A when dry (such as room temperature vulcanizable silicon or latex rubber) and from about 4% to about 30% (preferably from about 4% to about 6%) of a particulate electrically conductive material (such as carbon black). This paste may also, optionally, include a conventional solvent, such as methyl ethyl ketone.

The adhesive material may be applied in any convenient manner to form coating 17. When dissolved in the solvent, it may be screened on, painted on, or sprayed on. Preferably, the end of the doctor blade is simply dipped into the material having some solvent, and the resulting coating is then hardened by evaporation of the solvent to form coating 17.

Developer roller 9 comprises a semiconductive, organic elastomer charged to a predetermined potential by a fixed potential source. Roller 9 is contacted with a supply of charged toner as it rotates clockwise. The toner is normally primarily charged to a polarity the same as the polarity of the roller while having a significant amount of toner charged to the opposite polarity. The sector of roller 9 encountering the doctor blade carries such toner, and the toner of opposite polarity is blocked by the charged doctor blade so that only a thin layer of toner passes the doctor blade and that thin layer is charged in great predominance to the correct polarity.

Advantages of the doctor blades of this invention are reduced costs over blades having a lamination separate from the shim, improved performance, particularly in reducing streaks (sometimes termed skid marks), which occur in gray scale areas by variation in toner flow, caused by toner packing immediately prior to the nip (prenip packing), and elimination of fundamental damage during assembly which can occur from the developer roller being counter-rotated, thereby moving the separate lamination out of contact with the developer roller (normally, these cannot be repaired). This invention greatly reduces prenip packing over previously known flexible doctor blades.

Variation in the form and in the materials used are readily visualized and would be within the contemplation of this invention. Coverage is sought as provided by law, with particular reference to the accompany claims.

We claim:

1. A doctor blade for metering charged electrophotographic toner held on a developer roller by physically contacting a sector of said roller with a surface of said blade which is electrically charged, said blade comprising a supporting member to position said blade adjacent to said roller, a resilient layer attached to said supporting member, a shim attached to said resilient layer on a first side said shim being stiff in the process direction of said developer roller, at least the outer surface on a side opposite said first side of said shim being abrasive and electrically conductive, and an electrical conductor on said doctor blade in electrical contact with said outer surface of said shim.

2. The doctor blade as in claim 1 in which said shim has a body of polyester and said outer surface of said shim is a layer of abrasive and conductive material.

3. The doctor blade as in claim 2 in which said resilient layer is a porous material.

4. The doctor blade as in claim 3 in which said electrical conductor is a continuous coating of a layer of electrically conductive material at an end of said doctor blade which contacts said outer surface and said supporting member.

5. The doctor blade as in claim 4 in which said shim has a resin body and in which said outer surface is a coating on said body about 25 to 35 microns thick of abrasive particles and conductive filler in a resin body.

6. The doctor blade as in claim 3 in which said shim has a resin body and in which said outer surface is a coating on said body about 25 to 35 microns thick of abrasive particles and conductive filler in a resin body.

7. The doctor blade as in claim 2 in which said electrical conductor is a continuous coating of a layer of electrically conductive material at an end of said doctor blade which contacts said outer surface and said supporting member.

8. The doctor blade as in claim 7 in which said shim has a resin body and in which said outer surface is a coating on said body about 25 to 35 microns thick of abrasive particles and conductive filler in a resin body.

9. The doctor blade as in claim 2 in which said shim has a resin body and in which said outer surface is a coating on said body about 25 to 35 microns thick of abrasive particles and conductive filler in a resin body.

10. The doctor blade as in claim 1 in which said resilient layer is a porous material.

11. The doctor blade as in claim 10 in which said electrical conductor is a continuous coating of a layer of electrically conductive material at an end of said doctor blade which contacts said outer surface and said supporting member.

12. The doctor blade as in claim 11 in which said shim has a resin body and in which said outer surface is a coating on said body about 25 to 35 microns thick of abrasive particles and conductive filler in a resin body.

13. The doctor blade as in claim 10 in which said shim has a resin body and in which said outer surface is a coating on said body about 25 to 35 microns thick of abrasive particles and conductive filler in a resin body.

14. The doctor blade as in claim 1 in which said electrical conductor is a continuous coating of a layer of electrically conductive material at an end of said doctor blade which contacts said outer surface and said supporting member.

15. The doctor blade as in claim 14 in which said shim has a resin body and in which said outer surface is a coating on said body about 25 to 35 microns thick of abrasive particles and conductive filler in a resin body.

16. The doctor blade as in claim 1 in which said shim has a resin body and in which said outer surface is a coating on said body about 25 to 35 microns thick of abrasive particles and conductive filler in a resin body.

* * * * *